US005509360A

United States Patent [19]

Chiu

[11] Patent Number: 5,509,360

[45] Date of Patent: Apr. 23, 1996

[54] FOLDABLE TRAY TABLE

[75] Inventor: Mike Chiu, Taoyoan City, Taiwan

[73] Assignee: Waffer Industrial Corp., Taoyoan City, Taiwan

[21] Appl. No.: 354,852

[22] Filed: Dec. 9, 1994

[51] Int. Cl.[6] ..... A47B 3/02

[52] U.S. Cl. ..... 108/119; 108/131; 108/157; 248/164; 248/432

[58] Field of Search ..... 108/119, 115, 108/118, 154, 157, 128, 131; 248/164, 432

[56] References Cited

U.S. PATENT DOCUMENTS

| | | | |
|---|---|---|---|
| 3,265,019 | 8/1966 | Haydock | 108/119 |
| 4,168,669 | 9/1979 | Arnoff | 108/119 X |
| 4,462,636 | 7/1984 | Markson | 108/131 X |
| 4,544,203 | 10/1985 | Younger et al. | 108/118 X |
| 4,705,247 | 11/1987 | Delmerico | 108/118 X |
| 5,353,715 | 10/1994 | Luyk | 108/119 X |

FOREIGN PATENT DOCUMENTS

| | | | |
|---|---|---|---|
| 2611123 | 8/1988 | France | 108/123 |
| 17476 | 7/1910 | United Kingdom | 108/119 |

*Primary Examiner*—Peter M. Cuomo
*Assistant Examiner*—Janet M. Wilkens
*Attorney, Agent, or Firm*—Birch, Stewart, Kolasch & Birch

[57] ABSTRACT

A foldable tray table includes a board member which has a bottom surface formed with a pair of spaced mounting seat units and a pair of spaced retaining hook units that are spaced from the mounting seat units. A leg frame assembly includes first and second leg frame units. The first leg frame unit has two opposed side frames. Each of the side frames of the first leg frame unit has an upper end portion connected pivotally to a respective one of the mounting seat units and an intermediate portion. The second leg frame unit has two opposed side frames and a horizontal upper frame. Each of the opposed side frames of the second leg frame unit has an upper end portion and an intermediate portion connected pivotally to the intermediate portion of a respective one of the side frames of the first leg frame unit. The horizontal upper frame interconnects the upper end portions of the side frames of the second leg frame unit and is formed with two retaining holes that engage releasably a respective one of the retaining hook units so as to retain the leg frame assembly in an unfolded position.

9 Claims, 8 Drawing Sheets

FOLDABLE TRAY TABLE

BACKGROUND OF THE INVENTION

1. Field of the Invention

This invention relates to a foldable tray table, more particularly to a foldable tray table which is easy to assemble and which is made of plastic so as to reduce the total weight thereof.

2. Description of the Related Art

FIG. 1 shows a conventional foldable tray table which is usually used outdoors and which is made of wood. The conventional foldable tray table includes a rectangular board member 12 and a leg frame assembly 11 which is shown to be in an unfolded position. The leg frame assembly 11 includes a pair of spaced first leg frames 111 and a pair of spaced second leg frames 112. Each of the first leg frames 111 has an intermediate portion connected pivotally to a respective one of the second leg frames 112. A horizontal frame 13 interconnects the first leg frames 111 at the intermediate portions thereof.

Referring to FIG. 2, the conventional tray table further includes a plurality of mounting plates 121 (only one is shown). Each of the mounting plates 121 is secured to the bottom surface of the board member 12 adjacent to a respective one of the corners of the board member 12 by the extension of a metal screw 141 or a rivet therethrough and into the bottom surface of the board member 12. Each of the mounting plates 121 has a seat plate 122 which extends therefrom. The upper end portion of each of the leg frames 111, 112 is connected pivotally to a respective one of the seat plates 122 by means of a fastener 142.

The aforementioned conventional tray table has the following disadvantages:

1. Since the board member 12 is made of wood, metal screws 141 or rivets must be used in the connection between the board member 12 and the leg frame assembly 11. Therefore, it is time-consuming and laborious to assemble the conventional tray table.

2. Since the board member 12 is made of wood, and since the leg frame unit 11 is made of metal, the conventional tray table is relative heavy.

3. Since there is no connection between the lower end portions of the first leg frames 111 and the lower end portions of the second leg frames 112, a weaker structural strength is obtained.

SUMMARY OF THE INVENTION

Therefore, the main objective of the present invention is to provide a foldable tray table which is easy to assemble.

The second objective of the present invention is to provide a foldable tray table which is made of plastic so as to reduce the total weight thereof.

The third objective of the present invention is to provide a foldable tray table which has an improved structural strength.

According to the present invention, a foldable tray table includes a board member which has a bottom surface formed with a pair of spaced mounting seat units and a pair of spaced retaining hook units that are spaced from the mounting seat units, and a leg frame assembly. The leg frame assembly includes first and second leg frame units. The first leg frame unit has two opposed side frames. Each of the side frames of the first leg frame unit has an upper end portion connected pivotally to a respective one of the mounting seat units and an intermediate portion. The second leg frame unit has two opposed side frames and a horizontal upper frame. Each of the opposed side frames of the second leg frame unit has an upper end portion and an intermediate portion connected pivotally to the intermediate portion of a respective one of the side frames of the first leg frame unit. The horizontal upper frame interconnects the upper end portions of the side frames of the second leg frame unit and is formed with two retaining holes that engage releasably a respective one of the retaining hook units so as to retain the leg frame assembly in an unfolded position.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
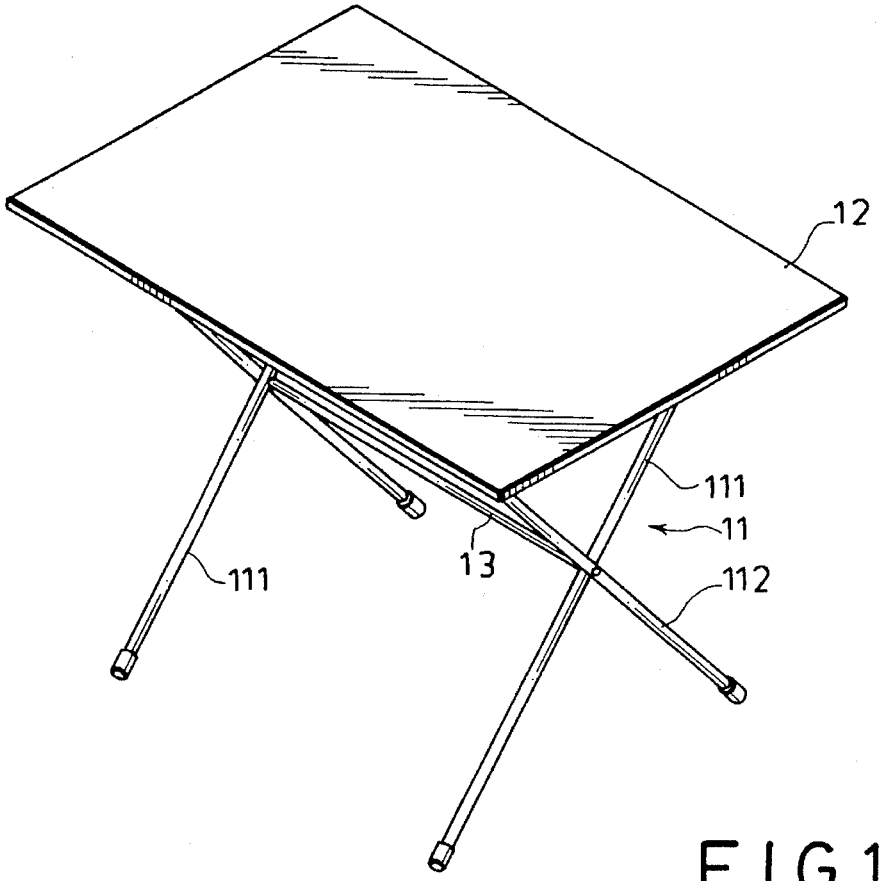
FIG.1 PRIOR ART
FIG. 1 is a perspective view showing a conventional foldable tray table, a leg frame assembly of the conventional foldable tray table being in an unfolded position.
Figure 2:
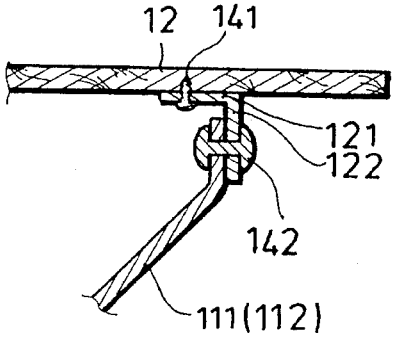
FIG.2 PRIOR ART
FIG. 2 is a sectional view showing the connection between the board member and the leg frame assembly of the conventional foldable tray table.
Figure 3:
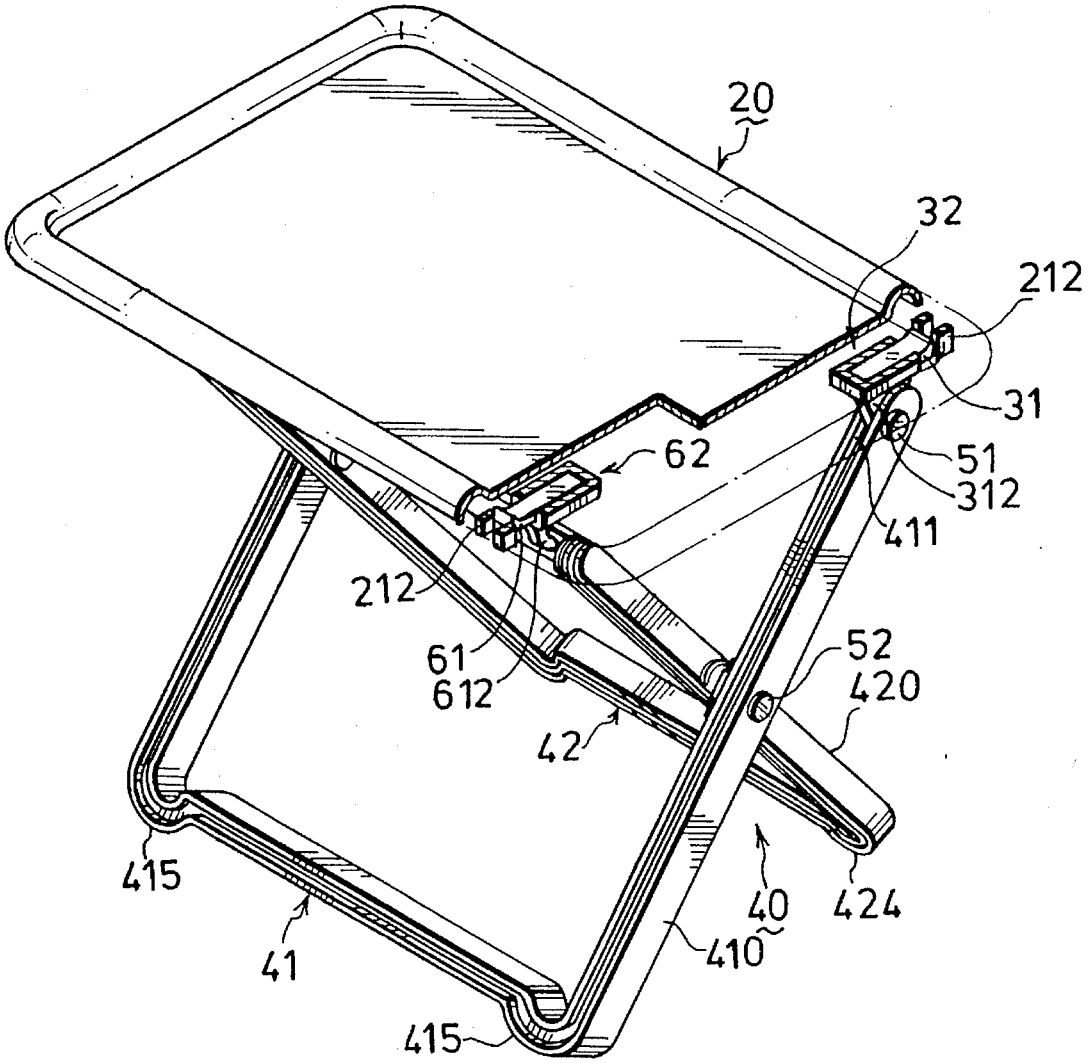
FIG. 3 is a perspective view of the preferred embodiment of a foldable tray table according to the present invention, a leg frame assembly of the preferred embodiment being in an unfolded position and a portion of a board member of the preferred embodiment being removed.
Figure 4:
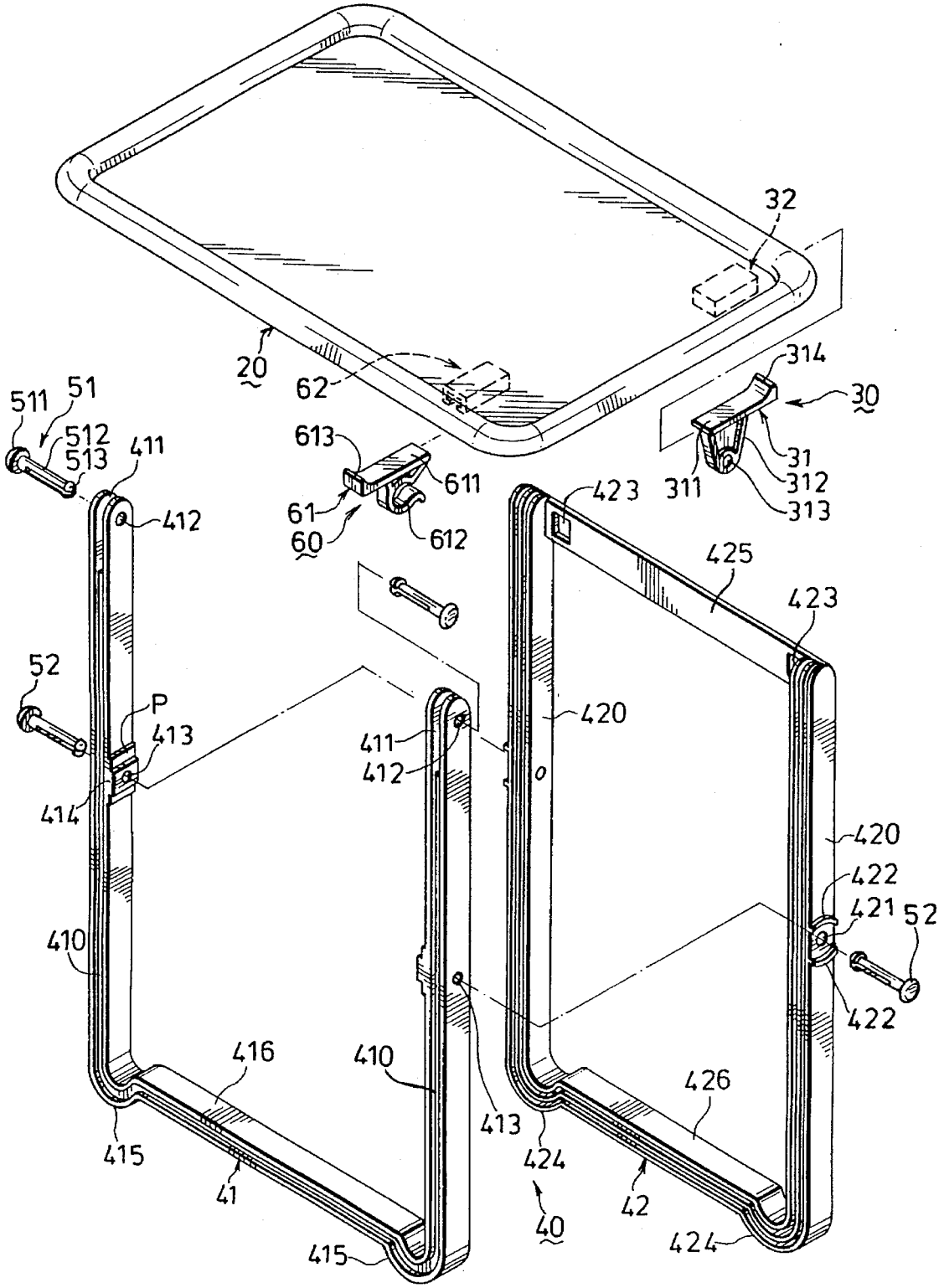
FIG. 4 is an exploded view of the preferred embodiment.
Figure 5:
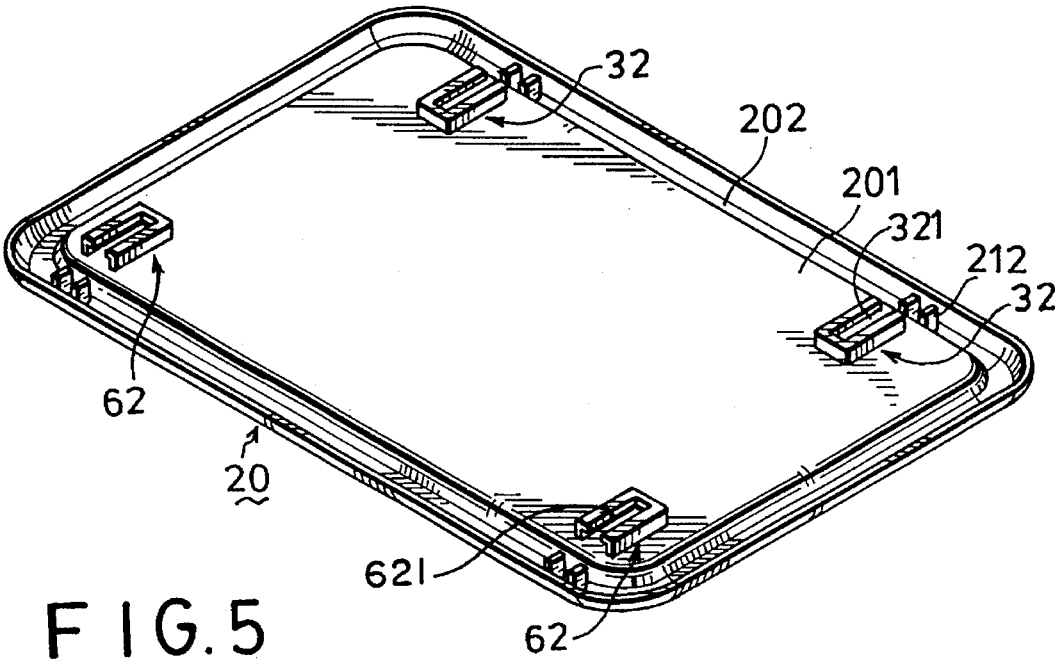
FIG. 5 is a perspective view illustrating a bottom surface of the board member of the preferred embodiment.

Referring to FIGS. 3, 4 and 5, a foldable tray table according to the present invention includes a board member 20 and a leg frame assembly 40.

Figure 6:
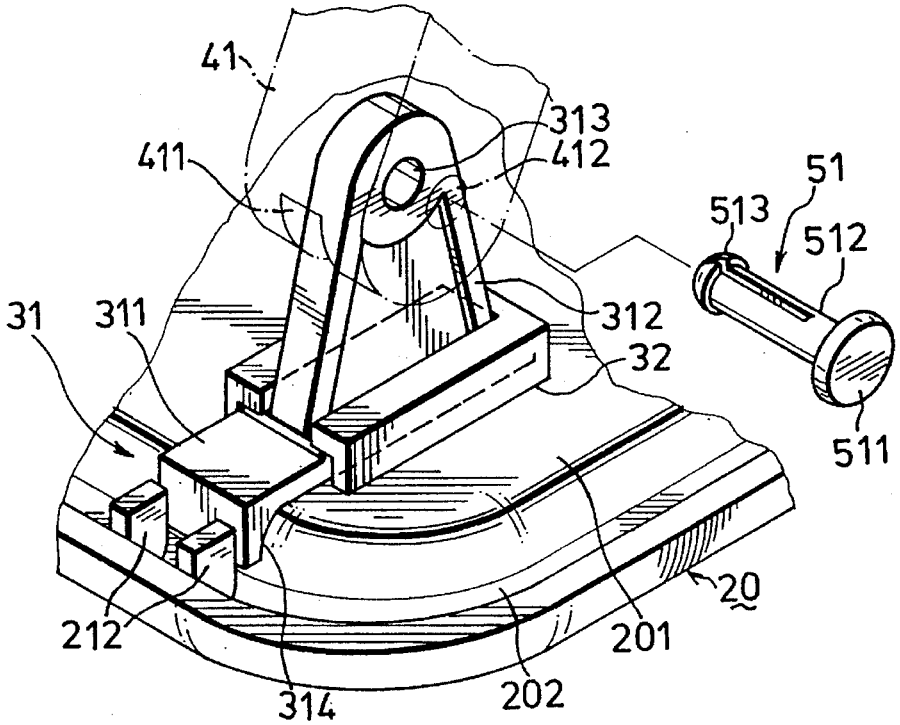
FIG. 6 is an enlarged view showing a portion of the preferred embodiment.

In the present embodiment, the board member 20 is made of plastic and is generally rectangular. The board member 20 has a bottom surface 201 which is formed with a mounting groove 202, a pair of spaced mounting seat units 30, and a pair of spaced retaining hook units 60 that are spaced from the mounting seat units 30. In the present embodiment, the mounting groove 202 is a peripheral mounting groove. Each of the mounting seat units 30 includes two first positioning members 32 which are formed integrally on the bottom surface 201 of the board member 20 and which are located adjacent to the mounting groove 202 and a respective one of the corners of the board member 20. Each of the first positioning members 32 is formed with a receiving groove 321. Each of the mounting seat units 30 further includes two mounting seat members 31. Each of the mounting seat members 31 has an insert plate portion 311 which is inserted into the receiving groove 321 of a respective one of the first positioning members 32 and a seat portion 312 which extends out of the receiving groove 321 of the respective one of the first positioning members 32 and which is formed with a through-hole 313. As best shown in FIG. 6, the insert plate portion 311 of each of the mounting seat members 31 has a first section which is inserted into the receiving groove 321 and a second section 314 which is opposite to the first section and which extends into the mounting groove 202 of the board member 20. The second section 314 of the insert plate portion 311 of each of the mounting seat members 31 abuts against a pair of spaced retaining projections 212 which are located in the mounting groove 202 of the board member 20 so as to prevent disengagement of the insert plate portion 311 from the receiving groove 321.

Figure 7:
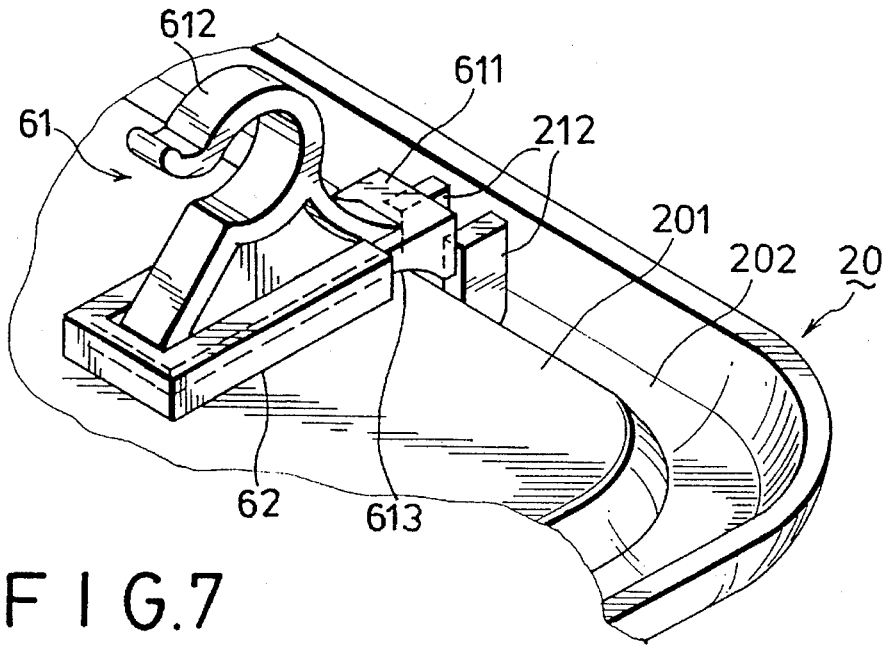
FIG. 7 is another enlarged view showing a portion of the preferred embodiment.

Each of the retaining hook units 60 includes two second positioning members 62 which are formed integrally on the bottom surface 201 of the board member 20 and which are located adjacent to the mounting groove 202 and a respective one of the remaining corners of the board member 20. Each of the second positioning members 62 is formed with a receiving groove 621. Each of the mounting seat units 60 further includes two retaining hook members 61. Each of the retaining hook members 61 has an insert plate portion 611 which is inserted into the receiving groove 621 of a respective one of the second positioning members 62 and a hook portion 612 which extends out of the receiving groove 621 of the respective one of the second positioning members 62. Each of the hook portions 612 opens toward an adjacent one of the first positioning members 32. As best shown in FIG. 7, the insert plate portion 611 of each of the retaining hook members 61 has a first section which is inserted into the receiving groove 621 and a second section 613 which is opposite to the first section and which extends into the mounting groove 202 of the board member 20. The second section 613 of the insert plate portion 611 of each of the retaining hook members 61 abuts against a pair of spaced retaining projections 212 which are located in the mounting groove 202 of the board member 20 so as to prevent disengagement of the insert plate portion 611 from the receiving groove 621.

The leg frame assembly 40 includes first and second leg frame units, 41 and 42. In the present embodiment, the first and second leg frame units, 41 and 42, are made of plastic. The first leg frame unit 41 has two opposed side frames 410. Each of the side frames 410 of the first leg frame unit 41 has an upper end portion which is formed with a receiving slot 411 and a through-hole 412. As best shown in FIG. 6, the upper end portion of each of the side frames 410 is connected pivotally to the seat portion 312 of a respective one of the mounting seat units 31 by receiving the seat portion 312 in the receiving slot 411 and by extending a fastener 51 through the through-hole 412 of the side frame 41 and the through-hole 313 of the seat portion 312 of the mounting seat unit 31. In the present embodiment, the fastener 51 is made of plastic and has an enlarged head 511 which is sized to prevent extension thereof into the through-holes 412, 313 and a pair of spaced-apart parallel holding strips 512 which define a space therebetween. The holding strips 512 extend into the through-holes 412,313 and have enlarged ends 513 which are sized so as to prevent disengagement of the fastener 51 from the through-holes 412, 313. Each of the side frames 410 of the first leg frame unit 41 further has a curved lower end portion 415 which opens upwardly. A horizontal lower frame 416 interconnects the lower end portions 415 of the side frames 410 of the first leg frame unit 41. Each of the side frames 410 of the first leg frame unit 41 has a rectangular projection 414 which extends from an inner side surface thereof at an intermediate portion thereof and toward the projection 414 of the other one of the side frames 410 of the first leg frame unit 41, and a pivot hole which extends through the side frame 410 and the rectangular projection 414. Two spacer projections (P) extend from the inner surface of each of the side frames 410 of the first leg frame unit 41 on two sides of the rectangular projection 414 such that the spacer projections (P) and the rectangular projection 414 cooperatively define a T-shaped configuration.

Figure 8:
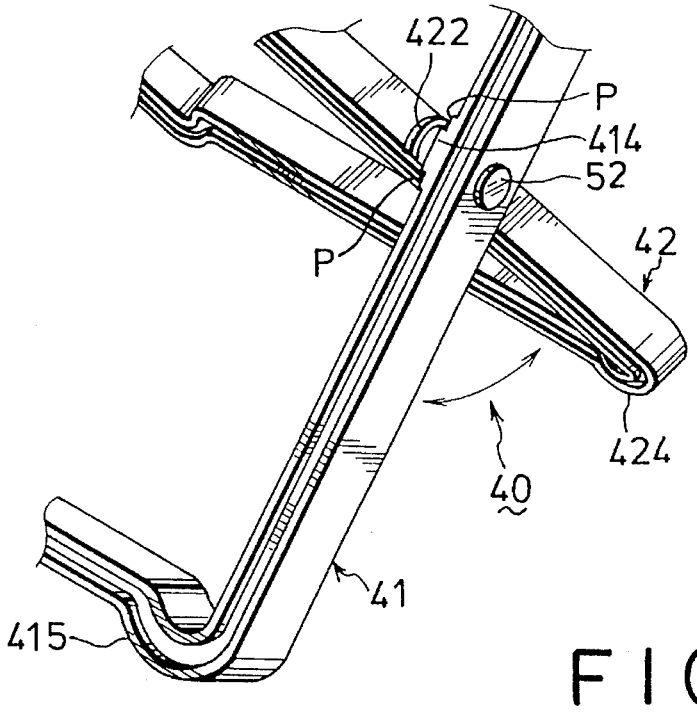
FIG. 8 is still another enlarged view showing a portion of the preferred embodiment.
Figure 9:
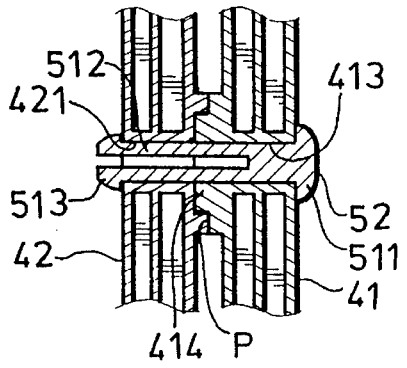
FIG. 9 is a sectional view Illustrating the connection between first and second leg frame units of the leg frame assembly of the preferred embodiment.

The second leg frame unit 42 has two opposed side frames 420. Each of the side frames 420 of the second leg frame unit 42 has a pair of guiding ribs 422 which extend from an outer side surface thereof and away from the guiding ribs 422 of the other one of the side frames 420 of the second leg frame unit 42 at an intermediate portion thereof and which open toward each other. Each of the side frames 420 of the second leg frame unit 42 further has a pivot hole 421 extending therethrough between the guiding ribs 422. It should be noted that the rectangular projection 414 has a longitudinal length smaller than a distance between distal ends of the guiding ribs 422, a diagonal length smaller than a longest distance between intermediate portions of the guiding ribs 422 of each pair, and a width smaller than a distance between one of the distal ends of one of the guiding ribs and one of the distal ends of the other one of the guiding ribs opposite to the one of the distal ends of the one of the guiding ribs. As best shown in FIGS. 8 and 9, each of the side frames 420 of the second leg frame unit 42 is connected pivotally to a respective one of the side frames 410 of the first leg frame unit 41 by receiving the rectangular projection 414 between the guiding ribs 422 and by extending a fastener 52 into the pivot holes 421, 413. It should be noted that the rectangular projection 414 can be easily received between the guiding ribs 422 since the width of the rectangular projection 414 is smaller than the distance between one of the distal ends of one of the guiding ribs 422 and one of the distal ends of the other one of the guiding ribs 422 as described hereinbefore. Since the structure of the fastener 52 is similar to that of the fastener 51, a detailed description thereof will be omitted herein. It should be appreciated that the spacer projections (P) are used to space the side frame 420 of the second frame unit 42 from the corresponding side frame 410 of the first frame unit 41 so as to prevent rubbing between the side frames 410, 420 when the first leg frame unit 41 is pivoted relative to the second leg frame unit 42. Each of the side frames 420 of the second leg frame unit 42 has a curved lower end portion 424 which opens upwardly. A horizontal lower frame 426 interconnects the lower end portions 424 of the side frames 420 of the second leg frame unit 42. Each of the side frames 420 of the second leg frame unit 42 further has an upper end portion connected to a respective end of a horizontal upper frame 425. The horizontal upper frame 425 is formed with two retaining holes 423 which engage releasably the hook portion 612 of a respective one of the retaining hook units 61 so as to retain the leg frame assembly 40 in an unfolded position (see FIGS. 3 and 9).

Referring now to FIG. 6, during assembly, the insert plate portion 311 of each of the mounting seat members 31 is inserted into the receiving groove 321 of the corresponding first positioning member 32. At this stage, the seat portion 312 of each mounting seat member 31 extends out of the receiving groove 321, while the second section 314 of each insert plate portion 311 extends into the mounting groove 202 of the board member 20 and abuts against the retaining projections 212. Then, the upper end portion of each side frame 410 is connected pivotally to the seat portion 312 of the corresponding mounting seat unit 31.

Referring now to FIG. 7, the insert plate portion 611 of each retaining hook member 61 is inserted into the receiving groove 621 of the corresponding second positioning member 62. At this stage, the hook portion 612 of each retaining hook member 61 extends out of the receiving groove 621, while the second section 613 of each insert plate portion 611 extends into the mounting groove 202 of the board member 20 and abuts against the retaining projections 212.

Figure 10:
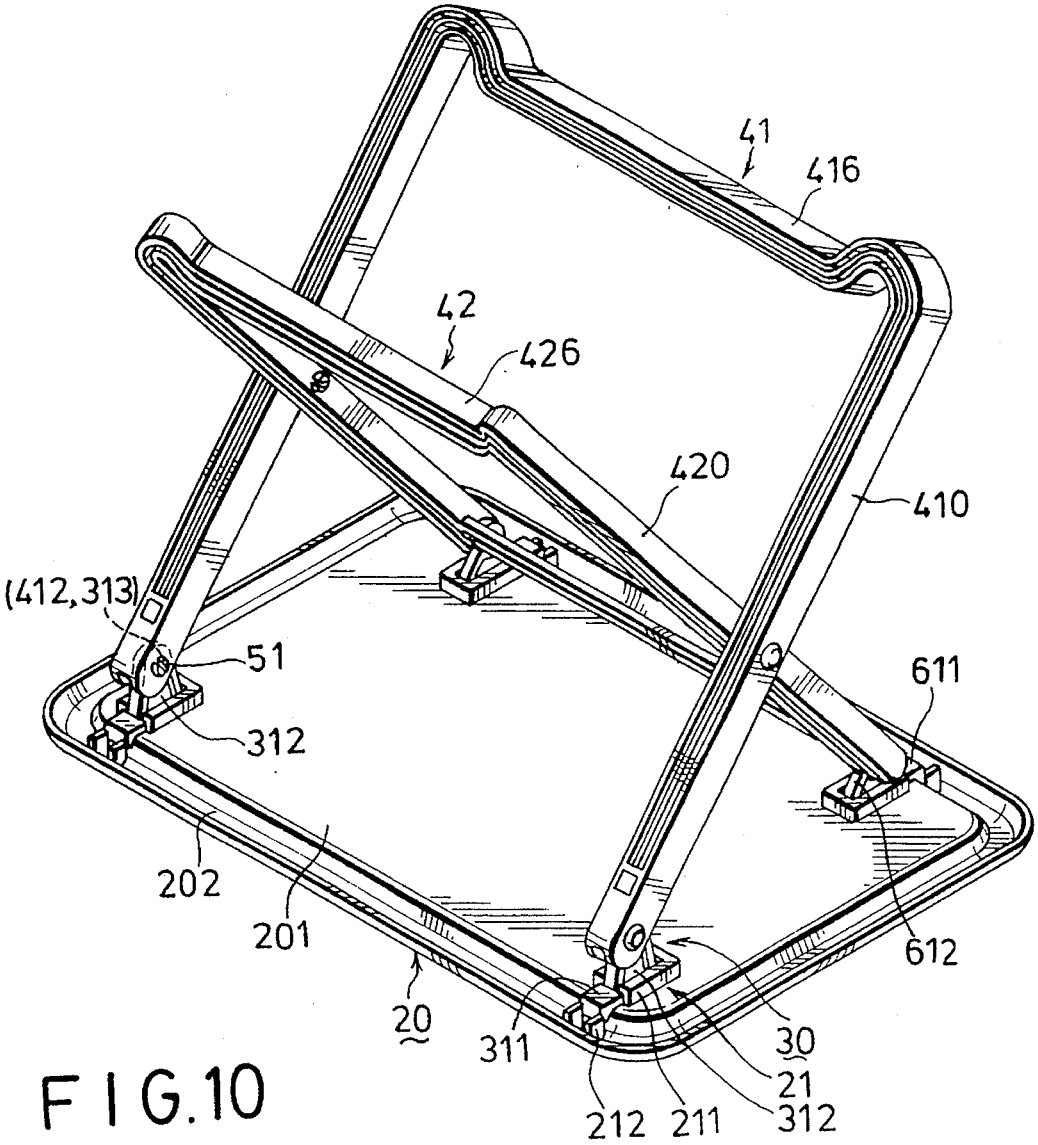
FIG. 10 is another perspective view of the preferred embodiment of the foldable tray table according to the present invention, the foldable tray table being inverted.
Figure 11:
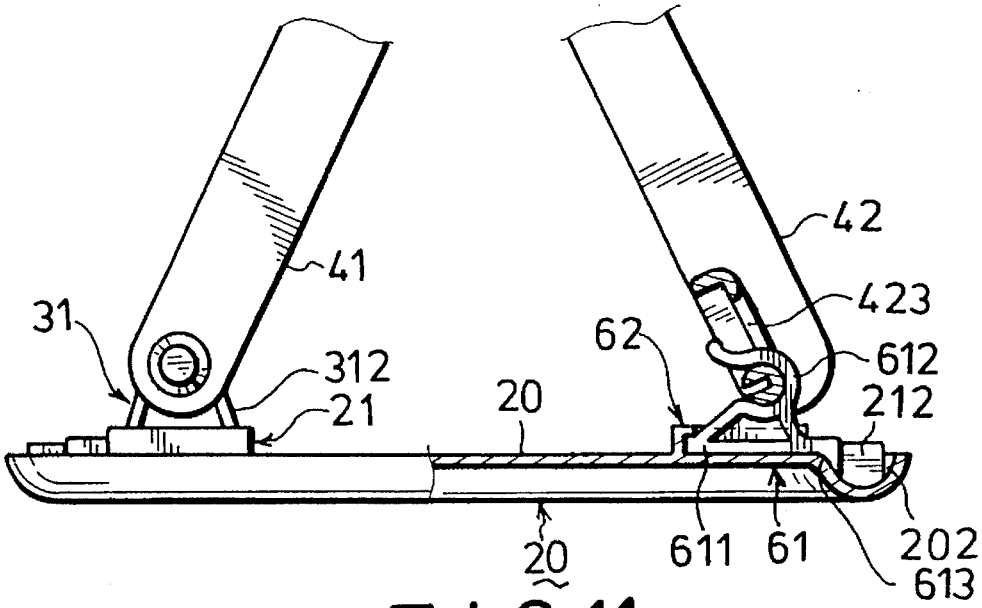
FIG. 11 is an enlarged view showing the relationship between the leg frame assembly and the board member of the preferred embodiment.

Referring now to FIGS. 8, 9 and 10, each side frame 420 of the second leg frame unit 42 is then connected pivotally to a respective one of the side frames 410 of the first leg frame unit 41 by means of the fastener 52 such that the second leg frame unit 42 is pivotable relative to the first leg frame unit 41 and such that the leg frame assembly 40 is retained in the unfolded position by the engagement between the hook portions 612 and the retaining holes 423 as illustrated in FIG. 11.

Figure 12:
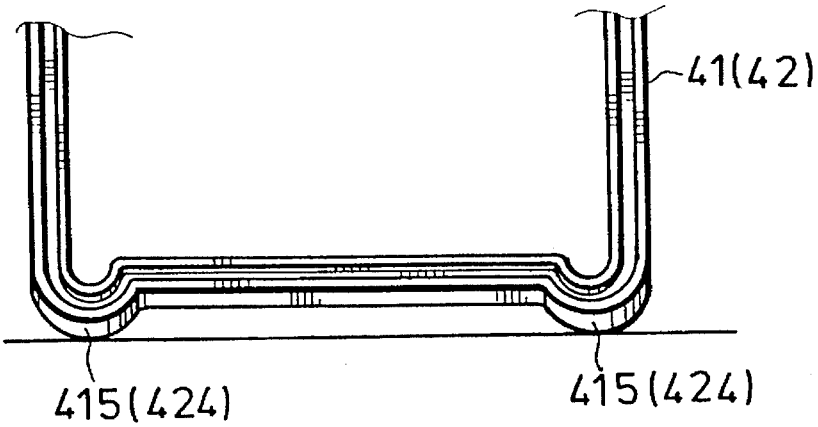
FIG. 12 is an enlarged view showing a part of the leg frame assembly of the preferred embodiment.

Referring now to FIG. 12, the curved lower end portions 415, 424 and the horizontal lower frames 416, 426 of the leg frame units 41, 42 has a greater structural strength as compared to the conventional foldable tray table described beforehand.

Figure 13:
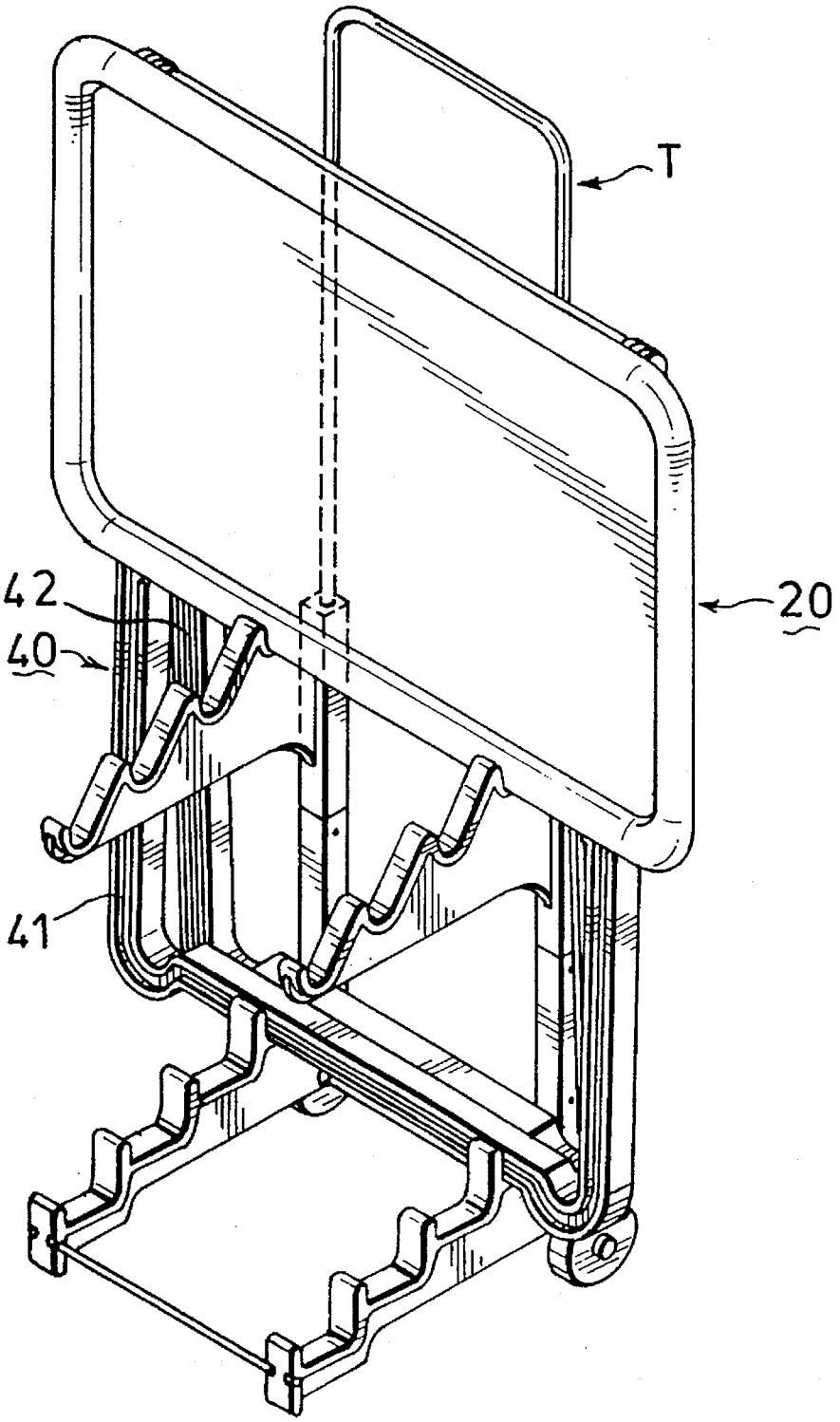
FIG. 13 is a perspective view of the preferred embodiment of the foldable tray table according to the present invention, the foldable tray table being folded and being carried on a cart.

Referring now to FIGS. 11 and 13, when using the foldable tray table of the present invention outdoors, the leg frame assembly 40 can be pivoted from the unfolded position to a folded position by releasing the hook portions 612 of the retaining hook members 61 from the retaining holes 423 of the second frame unit 42. The folded tray table can then be carried on a cart (T) for transportation. It should be noted that since the foldable tray table of the present invention is made of plastic, a plurality of foldable tray tables can easily be transported at the same time with the use of the cart (T) because the total weight thereof is relative light.

Accordingly, the foldable tray table of the present invention can be easily assembled without the use of any metal fastener. Furthermore, since the foldable tray table is made of plastic, the total weight thereof is thus lower and the foldable tray table can be manufactured in large quantities. Moreover, the provision of the curved lower end portions 415, 424 of the side frames 410, 420 of the leg frame units 41, 42 and the provision of the horizontal lower frames 416, 426 for interconnecting the lower end portions 415, 424 increase the structural strength of the leg frame assembly 40.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A foldable tray table, comprising:

a board member having a bottom surface formed with a pair of spaced mounting seat units and a pair of spaced retaining hook units which are spaced from said mounting seat units; and a leg frame assembly including first and second leg frame units, said first leg frame unit having two opposed side frames, each of said side frames of said first leg frame unit having an upper end portion connected pivotally to a respective one of said mounting seat units and an intermediate portion, said second leg frame unit having two opposed side frames and a horizontal upper frame, each of said opposed side frames of said second leg frame unit having an upper end portion and an intermediate portion connected pivotally to said intermediate portion of a respective one of said side frames of said first leg frame unit, said horizontal upper frame interconnecting said upper end portions of said side frames of said second leg frame unit and being formed with two retaining holes that engage releasably a respective one of said retaining hook units so as to retain said leg frame assembly in an unfolded position.

2. A foldable tray table as claimed in claim 1, wherein said board member and said leg frame assembly are made of plastic.

3. A foldable tray table as claimed in claim 1, wherein each of said mounting seat units includes two first positioning members formed integrally on said bottom surface of said board member, each of said first positioning members being formed with a receiving groove, each of said mounting seat units further including two mounting seat members, each of said mounting seat members having an insert plate portion which is inserted into said receiving groove of a respective one of said first positioning members and a seat portion which extends out of said receiving groove of said respective one of said first positioning members and which has said upper end portion of a respective one of said side frames of said first leg frame unit connected pivotally thereto.

4. A foldable tray table as claimed in claim 3, wherein said bottom surface of said board member is formed with a mounting groove adjacent to said first positioning members, said insert plate portion of each of said mounting seat members having a first section which is inserted into said receiving groove and a second section which is opposite to said first section and which extends into said mounting groove, said bottom surface of said board member being further formed with at least one retaining projection located in said mounting groove and abutting against said second section of said insert plate portion of a respective one of said mounting seat members so as to prevent disengagement of said respective one of said insert plate portions from said receiving groove.

5. A foldable tray table as claimed in claim 1, wherein each of said retaining hook units includes two second positioning members formed integrally on said bottom surface of said board member, each of said second positioning members being formed with a receiving groove, each of said retaining hook units further including two retaining hook members, each of said retaining hook members having an insert plate portion which is inserted into said receiving groove of a respective one of said second positioning members and a hook portion which extends out of said receiving groove of said respective one of said second positioning members and which engages releasably a respective one of said retaining holes of said horizontal upper frame of said second leg frame unit.

6. A foldable tray table as claimed in claim 4, wherein said bottom surface of said board member is formed with a mounting groove adjacent to said second positioning members, said insert plate portion of each of said retaining hook members having a first section which is inserted into said receiving groove and a second section which is opposite to said first section and which extends into said mounting groove, said bottom surface of said board member being further formed with at least one retaining projection located in said mounting groove and abutting against said second section of said insert plate portion of a respective one of said retaining hook members so as to prevent disengagement of said respective one of said insert plate portions from said receiving groove.

7. A foldable tray table as claimed in claim 1, wherein each of said side frames of said first leg frame unit further has a curved lower end portion which opens upwardly, said first leg frame unit further having a horizontal lower frame interconnecting said lower end portions of said side frames of said first leg frame unit, each of said side frames of said second leg frame unit further having a curved lower end portion which opens upwardly, said second leg frame unit further having a horizontal lower frame interconnecting said lower end portions of said side frames of said second leg frame unit.

8. A foldable tray table as claimed in claim 1, wherein each of said side frames of said first leg frame unit has an inner side surface, a rectangular projection extending from said inner side surface at said intermediate portion thereof and toward said projection of the other one of said side frames of said first leg frame unit, and a pivot hole extending through said side frame and said rectangular projection, each of said side frames of said second leg frame unit having an outer side surface, and a pair of spaced curved guiding ribs which extend from said outer side surface and away from said pair of guiding ribs of the other one of said side frames of said second leg frame unit at said intermediate portion thereof and which open toward each other, said guiding ribs of each of said side frames of said second leg frame unit receiving therebetween said rectangular projection of a respective one of said side frames of said first leg frame unit, each of said side frames of said second leg frame unit further having a pivot hole extending therethrough between said guiding ribs, said leg frame assembly further including two pivot pins, each of said pivot pins extending into said pivot hole of a respective one of said side frames of said first leg frame unit and said pivot hole of a respective one of said side frames of said second leg frame unit so as to connect pivotally said respective one of said side frames of said first leg frame unit to said respective one of said side frames of said second leg frame unit.

9. A foldable tray table as claimed in claim 8, wherein each of said guiding ribs of each said pair has two distal ends, said rectangular projection having a longitudinal length smaller than a distance between said distal ends of said guiding ribs, a diagonal length smaller than a longest distance between intermediate portions of said guiding ribs of each said pair, and a width smaller than a distance between one of said distal ends of one of said guiding ribs and one of said distal ends of the other one of said guiding ribs opposite to said one of said distal ends of said one of said guiding ribs.

* * * * *